US007725223B2

(12) United States Patent
Gordon et al.

(10) Patent No.: US 7,725,223 B2
(45) Date of Patent: May 25, 2010

(54) CONTROL ARRANGEMENT FOR A PROPULSION UNIT FOR A SELF-PROPELLED FLOOR CARE APPLIANCE

(75) Inventors: Evan A. Gordon, Canton, OH (US); Ethan S. Miller, Urbana, IL (US)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 280 days.

(21) Appl. No.: 11/528,049

(22) Filed: Sep. 26, 2006

(65) Prior Publication Data

US 2007/0061058 A1 Mar. 15, 2007

Related U.S. Application Data

(63) Continuation-in-part of application No. 10/677,999, filed on Sep. 30, 2003, now abandoned.

(51) Int. Cl.
*G01C 22/00* (2006.01)
*G06F 19/00* (2006.01)

(52) U.S. Cl. ..... 701/23; 701/25; 701/27; 700/245; 700/253; 700/255; 700/258

(58) Field of Classification Search ..... None
See application file for complete search history.

(56) References Cited

U.S. PATENT DOCUMENTS

| | | | | |
|---|---|---|---|---|
| 3,581,591 | A | 6/1971 | Ziegler et al. | |
| 4,709,771 | A | 12/1987 | Basham et al. | |
| 5,044,043 | A | 9/1991 | Basham et al. | |
| 5,086,862 | A * | 2/1992 | Graber et al. | 180/422 |
| 5,130,710 | A * | 7/1992 | Salazar | 341/11 |
| 5,285,550 | A | 2/1994 | Meyer et al. | |
| 5,504,971 | A | 4/1996 | McCormick | |
| 6,061,869 | A | 5/2000 | Ettes et al. | |
| 6,313,597 | B1 | 11/2001 | Elliott et al. | |
| 6,925,679 | B2 * | 8/2005 | Wallach et al. | 15/319 |
| 7,076,830 | B2 * | 7/2006 | Conner et al. | 15/339 |
| 7,167,775 | B2 | 1/2007 | Abramson et al. | |

(Continued)

FOREIGN PATENT DOCUMENTS

| | | |
|---|---|---|
| JP | 01185233 | 7/1989 |

(Continued)

OTHER PUBLICATIONS

PCT/US2007/019037 Search Report, 3 pages, dated Feb. 15, 2008.

*Primary Examiner*—Khoi Tran
*Assistant Examiner*—Bhavesh V Amin
(74) *Attorney, Agent, or Firm*—Michael Best & Friedrich LLP

(57) ABSTRACT

A self propelled upright vacuum cleaner is provided with a Hall effect sensor to provide a Hall voltage that varies according to the position of a handgrip maintained by the vacuum cleaner. A microprocessor generates a PWM control signal to control the movement of the vacuum based on the magnitude of the Hall voltage with respect to various response characteristics, including a non-linear logistic function. As such, the vacuum cleaner imparts a user-friendly responsiveness to the user during the operation of the vacuum cleaner.

10 Claims, 7 Drawing Sheets

U.S. PATENT DOCUMENTS

| | | | |
|---|---|---|---|
| 7,360,275 | B2 | 4/2008 | Allgeier et al. |
| 7,503,097 | B2 | 3/2009 | Kim et al. |
| 2003/0060928 | A1 | 3/2003 | Abramson et al. |
| 2004/0135537 | A1 | 7/2004 | Conner et al. |
| 2005/0071056 | A1 | 3/2005 | Tondra et al. |
| 2006/0021182 | A1 | 2/2006 | Kim et al. |

FOREIGN PATENT DOCUMENTS

| | | |
|---|---|---|
| WO | WO 99/07272 | 2/1999 |
| WO | 2008039287 | 4/2008 |

* cited by examiner

CONTROL ARRANGEMENT FOR A PROPULSION UNIT FOR A SELF-PROPELLED FLOOR CARE APPLIANCE

CROSS-REFERENCE TO RELATED APPLICATION

The instant application is a continuation-in-part of U.S. patent application Ser. No. 10/677,999 filed on Sep. 30, 2003 now abandoned, which is also incorporated herein by reference.

TECHNICAL FIELD

The present invention is directed to controls for a floor care appliance. Specifically, the present invention relates to a programmable control for controlling the movement of a self-propelled floor care appliance. More specifically, the present invention is directed to a programmable control that adjusts the speed of a floor care appliance in accordance with a preprogrammed response characteristic, such as a non-linear logistic function.

BACKGROUND OF THE INVENTION

It is known to produce a self-propelled upright vacuum cleaner by providing a transmission in the foot or lower portion of the vacuum cleaner for selectively driving at least one drive wheel in forward rotation and reverse rotation to propel the vacuum cleaner in forward and reverse directions over a floor. A handgrip is commonly mounted to the top of the upper housing in a sliding fashion for limited reciprocal motion relative to the upper housing as a user pushes and pulls on the handgrip to direct the movement of the vacuum cleaner 10. A Bowden type control cable typically extends from the hand grip to the transmission for transferring the pushing and pulling forces applied to the hand grip by the user to the transmission, which selectively actuates a forward drive clutch and a reverse drive clutch of the transmission so as to propel the vacuum cleaner 10 in similar directions.

However, such arrangements provide little or no flexibility in providing for controlling the speed of the propulsion drive motor. That is, the vacuum cleaner typically tends to abruptly move forward and backward, in coordination with the movement of the handgrip. This results in a vacuum that is difficult for the average user to effectively control and maneuver. For example, in environments, such as a living room or bedroom, where the vacuum encounters many obstacles in its path it may be especially difficult for the user to exercise precise control so at to prevent the vacuum cleaner from colliding with such obstacles. Moreover, the abrupt movements of the vacuum cleaner may cause physical injury to the user of the vacuum cleaner as well.

Therefore, there is a need for a self-propelled vacuum cleaner that provides a programmable control system that can control the movement of the vacuum cleaner in accordance with various response characteristics. Furthermore, there is a need for a self-propelled vacuum cleaner that provides a programmable control system that controls the movement of the vacuum cleaner in accordance with a logistic function based response characteristic. In addition, there is a need for a self-propelled vacuum cleaner that includes a selection switch that allows an operator to select a desired response characteristic that is to be used to control the vacuum cleaner. Still yet, there is a need for a self-propelled vacuum cleaner that includes a response button that allows an operator to adjust the responsiveness of a particular response characteristic.

SUMMARY OF THE INVENTION

It is thus an object of the present invention to provide a self-propelled vacuum cleaner that may be controlled in accordance with movements of a handgrip maintained by the vacuum cleaner.

It is another object of the present invention to provide a self-propelled vacuum cleaner that moves in accordance with a logistic function based response characteristic.

It is yet another object of the present invention to provide a self-propelled vacuum cleaner that utilizes a lookup table maintained by a microprocessor, such that the lookup table maintains a plurality of predetermined digital Hall voltage levels that are each associated with a pulse width modulation (PWM) output level in accordance with the response characteristic.

It is still another object of the present invention to provide a self-propelled vacuum cleaner that utilizes a lookup table maintained by the microprocessor, such that the predetermined Hall voltage levels and pulse width modulation (PWM) output levels may be scaled, such that the mathematical relationship between the Hall voltage levels and the PWM output levels is retained.

These and other objects of the present invention, as well as the advantages thereof over existing prior art forms, which will become apparent from the description to follow, are accomplished by the improvements hereinafter described and claimed.

In general, a self-propelled floor care appliance comprises a drive motor to propel the floor care appliance over a surface to be cleaned. A Hall effect sensor is positioned in an operative relationship with a handgrip that is maintained by the floor care appliance. Based on the movement of the handgrip, the Hall effect sensor is configured to provide a corresponding Hall voltage. A microprocessor is configured to receive the Hall voltage from the Hall effect sensor, and also stores a response characteristic. The microprocessor supplies a pulse width modulation control signal to the drive motor based upon the Hall voltage and the response characteristic, so as to propel the floor care appliance over the surface to be cleaned.

In accordance with another aspect of the present invention, a method for controlling the movement of a microprocessor controlled, motor driven vacuum cleaner in accordance with a movable handgrip comprises the steps of generating a digitized Hall voltage based upon the position of the handgrip. Next, the microprocessor is provided with a response characteristic. After the microprocessor is provided with a response characteristic, a pulse width modulation (PWM) control signal is generated, containing a pulse width modulation output level based on the position of the handgrip and the response characteristic. Finally, the motor is controlled in accordance with the PWM control signal, so as to propel the floor care appliance in accordance with the movement of the handgrip.

In accordance with yet another aspect of the present invention, a self-propelled floor care appliance controlled by a moveable handgrip comprises a drive motor to control the movement of the floor care appliance. A Hall effect sensor in operative communication with the handgrip is configured to generate a Hall voltage based on the movement of the handgrip. A microprocessor, which maintains a lookup table, is coupled to the Hall effect sensor. The lookup table associates a plurality of predetermined digital Hall voltage levels with predetermined pulse width modulation (PWM) output levels in accordance with a logistic response characteristic. Wherein the microprocessor outputs a pulse width modulation (PWM) control signal to the drive motor, such that the PWM control signal includes one of said PWM output levels associated with Hall voltage output by the Hall effect sensor in accordance with the lookup table.

A preferred exemplary self-propelled vacuum cleaner incorporating the concepts of the present invention is shown by way of example in the accompanying drawings without attempting to show all the various forms and modifications in which the invention might be embodied, the invention being measured by the appended claims and not by the details of the specification.

BRIEF DESCRIPTION OF DRAWINGS

Embodiments of the invention, illustrative of several modes in which applicants have contemplated are set forth by way of example in the following description and drawings, which are particularly and distinctly pointed out and set forth in the appended claims.

DESCRIPTION OF THE PREFERRED EMBODIMENT

Figure 1:
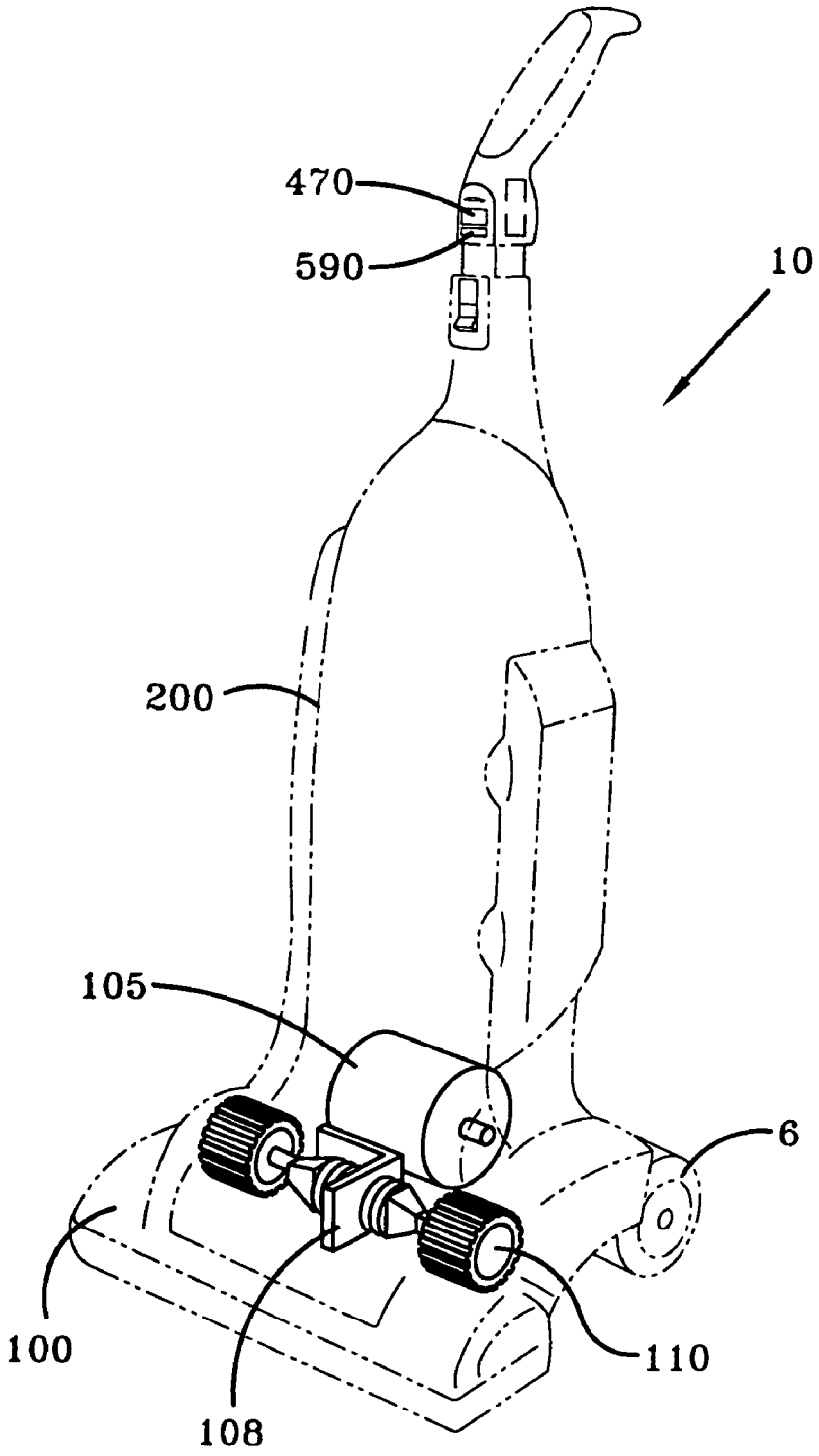
FIG. 1 is a perspective view of a vacuum cleaner which includes the present invention.

A self-propelled upright vacuum cleaner 10 is generally referred to by the numeral 10, as shown in FIG. 1 of the drawings. The vacuum cleaner 10 comprises a foot or lower engaging portion 100 that maintains an agitator (not shown) and an agitator chamber (not shown) that is formed in an agitator housing (not shown). The agitator chamber communicates with a nozzle opening (not shown), while the agitator rotates about a horizontal axis inside the agitator chamber, so as to loosen dirt from a floor surface. A suction airstream generated by a motor-fan assembly (not shown) draws the loosened dirt into a suction duct (not shown) located behind, and fluidly connected to the agitator chamber. The suction duct directs the loosened dirt to a dirt particle filtration and collecting system (not shown), which is positioned in an upper housing 200. Freely rotating support wheels 6 (only one of which is visible in FIG. 1) are located to the rear of the foot 100. The foot 100 further includes a transmission 108 and drive wheels 110 for propelling the vacuum cleaner 10 in forward and reverse directions over a floor. A rotary power source, such as an electric motor 105, provides rotary power to the transmission 108. A suitable transmission for use with a self-propelled upright vacuum cleaner according to the present invention is disclosed in U.S. Pat. No. 3,581,591, the disclosure of which is herein incorporated by reference.

Figure 2:
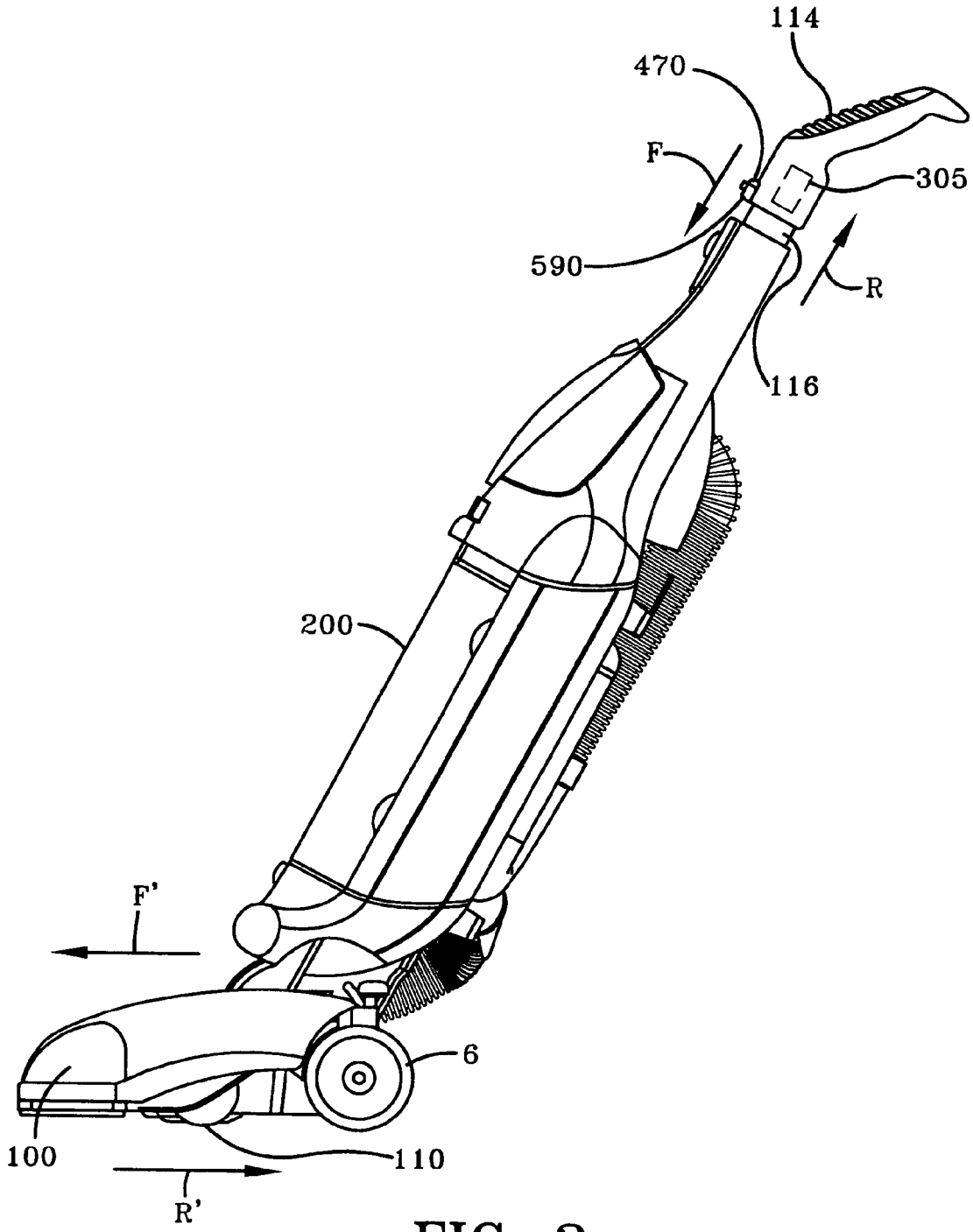
FIG. 2 is the vacuum cleaner of FIG. 1 with a partial cutaway portion of the housing with the handle in the in use position.

The upper housing portion 200 of the vacuum cleaner 10 is pivotally mounted to the foot 100 to allow pivotal motion from a generally upright latched storage position, as illustrated in FIG. 1, to an inclined pivotal operating position, as shown in FIG. 2. In one embodiment of the present invention, the vacuum cleaner 10 is similar to the indirect air bagless vacuum cleaner 10 disclosed in U.S. patent application Ser. No. 10/417,866, which is incorporated herein by reference. In an alternate embodiment of the present invention, the vacuum cleaner 10 may be a direct air vacuum cleaner or any other type of floor care appliance.

In one embodiment of the present invention, a handgrip 114 is slidably mounted to a handle stem 116 that is attached to the upper end of the upper housing portion 200. This arrangement allows for limited reciprocal rectilinear motion of the handgrip 114 relative to the handle stem 116, as illustrated by arrows F and R. The handgrip 114 controls the speed and direction of the drive wheels 110, via motor 105 and transmission 108, using an electronic switching arrangement. Shown in FIG. 3, the electronic switching arrangement comprises an analog linear Hall effect sensor 310 located in proximity to a magnet 305. The Hall effect sensor 310 generates an analog Hall voltage, the magnitude of which corresponds to the position of the Hall effect sensor 310 in relation to the magnet 305. The Hall voltage is input to a control circuit 400, shown in FIG. 4, that maintains a microprocessor 450, and associated electrical components to be discussed to control the speed and direction of the motor 105. It should be appreciated that the microprocessor 450 may comprise an application specific or general purpose processor having the necessary combination of hardware, software, and memory to carryout the functions to be described below. In addition, the memory utilized by the microprocessor 450 could be comprised of non-volative memory or a combination of non-volatile memory and volatile memory. It should also be appreciated that while the voltage output by the Hall sensor 310 is an analog voltage, it is converted into a digital or discrete voltage level using known techniques to be discussed. Finally, returning to FIG. 3, the vacuum cleaner 10 includes a power switch 304 that is preferably located adjacent to the top of the handle stem 116, near the handgrip 114, for conveniently turning the vacuum cleaner 10 on and off.

During operation of the cleaner 10, movement of the handgrip 114 in the direction of arrow F causes the microprocessor 450 to generate the necessary signals to propel the cleaner 10, via the drive wheels 110, in the direction of arrow F'. Similarly, movement of the handgrip 114 in the direction of arrow R, causes the microprocessor 450 to propel the vacuum cleaner 10, via drive wheels 110, in the direction of arrow R'. The speed by which the cleaner 10 is propelled in the forward F' and reverse R' directions is dependent on the position of the handgrip 114, and on a pre-programmed response characteristic maintained by the microprocessor 450. In other words, the movement speed and the responsitivity of the vacuum's movement to the actuation of the handgrip 114 is dictated by both the response characteristic and the position of the handgrip 114, as it is moved during operation of the vacuum cleaner 10.

Figure 3:
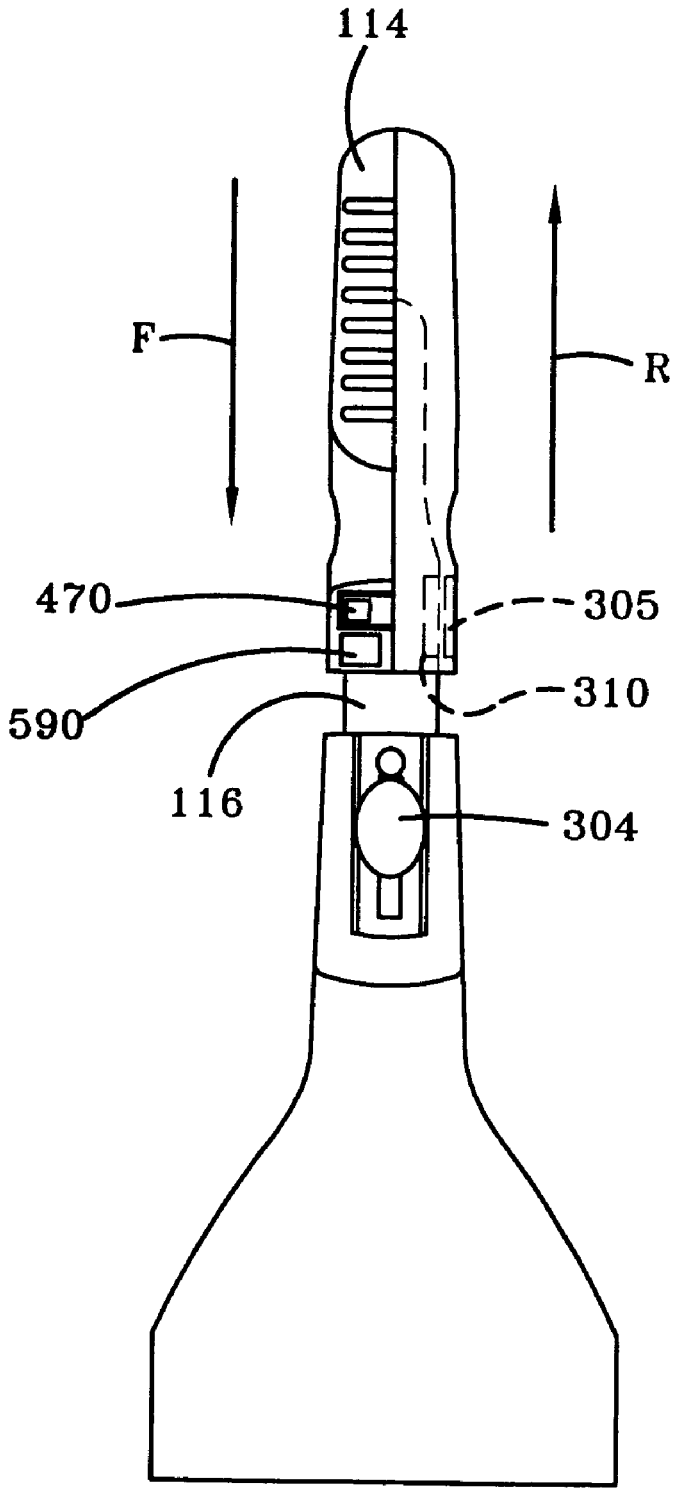
FIG. 3 is a cutaway portion of the upper handle with a partial cutaway portion of the handgrip showing the Hall effect sensor and magnet.

The various response characteristics control the speed and responsiveness of the motor 105, based on the position of the handgrip 114. Specifically, response characteristics may embody a mathematical expression, function, or algorithm, and can be represented graphically as illustrated in FIGS. 5B-5D, and FIG. 6, which will be more fully described herein below. In one aspect, as shown in FIGS. 1-3, a selection switch 470 coupled to the microprocessor 450, may be provided to allow a user to select one of several possible response characteristics stored in the memory of the microprocessor 450 for use during operation of the vacuum cleaner 10. For example, the microprocessor 450 may maintain a responsive response characteristic that is highly responsive for use when the vacuum cleaner 10 is used in tight areas, and a response characteristic having a smooth response may be used for when the vacuum cleaner 10 is used in large, open areas, for example. Furthermore, response characteristics can be initially programmed into the microprocessor 450 at the time of manufacturing or may be added later via a connection (not shown) to a computer (not shown) or computer network (not shown). It should also be appreciated that the response characteristics may be wirelessly transmitted from a computing device to the microprocessor 450, if the microprocessor 450 is provided with a suitable receiver or transceiver configured to receive wireless signals therefrom.

Figure 4:
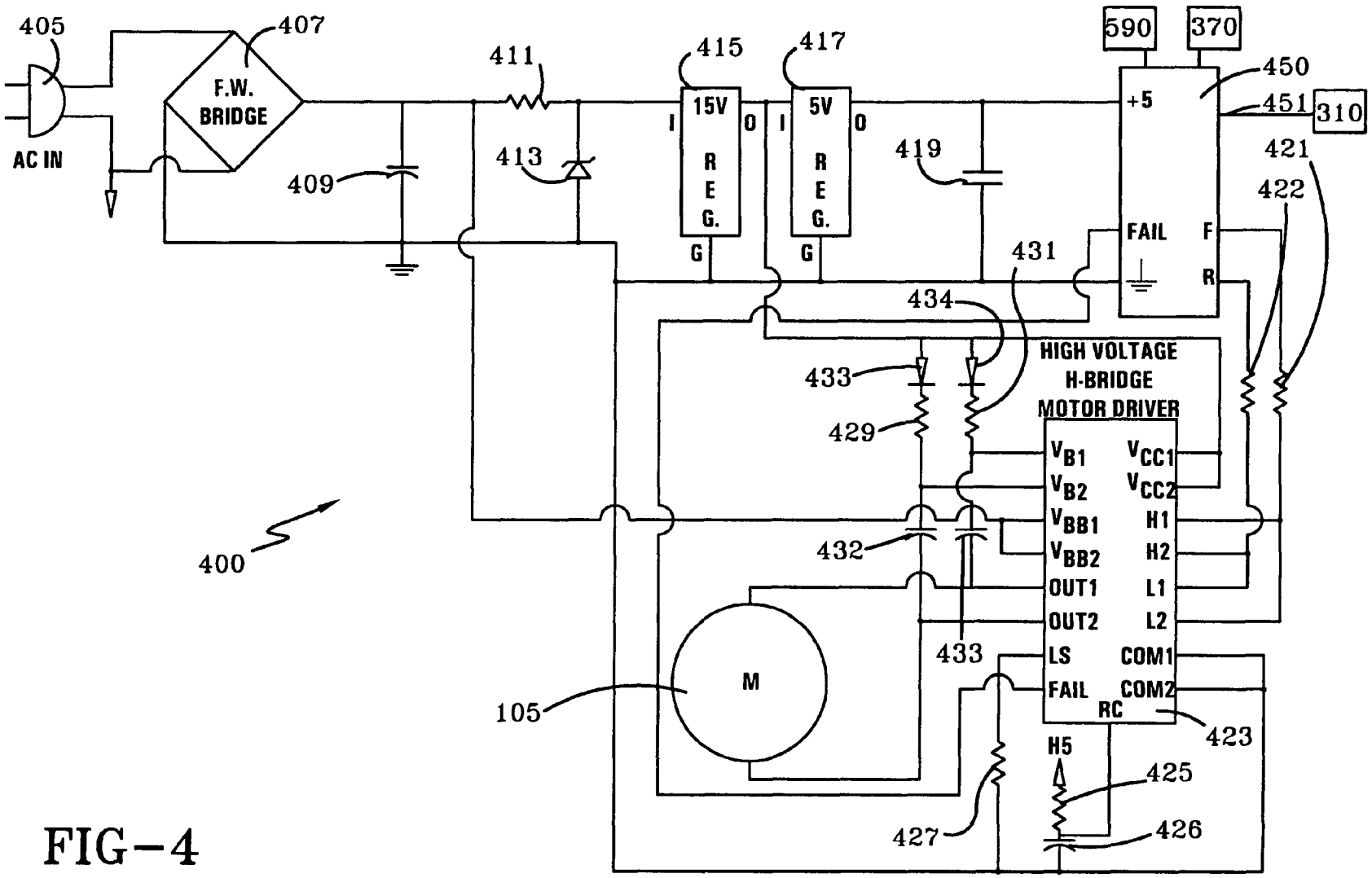
FIG. 4 is an electrical schematic of the control circuit having a programmable microprocessor for controlling a propulsion arrangement having a variable and user selectable response characteristic.

A schematic view of the control circuit 400 for providing and controlling the power supplied to the motor 105 in accordance with various response characteristics is shown in FIG. 4. Specifically, the control circuit 400 includes a 120V AC (alternating current) power source 405 that is connected to a full Wheatstone bridge 407 to convert the AC power into 170V DC (direct current) power. A 220 uF smoothing capacitor 409 smooths the 170V DC power delivered from the bridge 407. A 2.2K ohm resistor 411, and a Zener diode 413 having a 33V zener voltage, clamps the voltage across its terminals to 33V, which is input to a voltage regulator 415, which outputs a regulated 15V DC that is supplied to an H-Bridge motor driver 423. The H-Bridge motor driver 423 is of a well known type using MOSFETS (metal-oxide field effect transistors) to control the current supplied to the motor 105. The 15V DC output from the 15V voltage regulator 415 is input to a 5V voltage regulator 417, which outputs a regulated 5V DC to the microprocessor 450. The analog Hall voltage output from the Hall effect sensor 310, determined by the relative position of the handgrip 114, is input to pin 451 of the microprocessor 450, whereby it is digitized into a digital or discrete voltage level via an analog-to-digital converter or ADC. In addition to digitizing the Hall voltage, the microprocessor 450 analyzes the magnitude of the digitized voltage level of the Hall voltage so as to determine which direction the handgrip 114 is moved. Specifically, the ADC may utilize 8 bits to represent the analog Hall voltage of as one of 256 discrete voltage levels, for example. However, an 8-bit ADC is not required for the operation of the present invention, as the ADC may utilize any number of bits. Moreover, as the number of bits utilized by the ADC increases, so does the precision and the smoothness in which the handgrip 114 is able to control the forward F' and reverse R' movement of the vacuum cleaner 10. It should be appreciated that the ADC may be maintained as a discrete component, separate from the microprocessor 450, or may be directly integrated within the logic and circuitry of the microprocessor 450.

Continuing with the discussion of the control circuit 400, a charge pump circuit charges the external capacitors 432, 433 between the output pins OUT1 and OUT2, and the VB1 and VB2 pins. Capacitors 432, 433 provide suitable voltage to the high side driver circuit so as to drive the high side MOSFET of the H-bridge 423. The charging process occurs when the output voltage is low. A pair of resistors 429, 431 and a pair of diodes 433, 434 form a current limiting circuit that limits the current flowing to pins VB1 and VB2. A resistor 427 connected to the low side output pin LS is used as a current sense to determine if a stall of the motor 105 has occurred during operation of the vacuum cleaner 10. If a motor stall has occurred, then the control circuit 400 shuts down the motor 105. An RC network comprised of a resistor 425 and a capacitor 426 has the ability to shut down the control circuit 400 if the current through the control circuit 400 reaches a fixed level. The varying current in the control circuit 400 charges and discharges the RC network, and when the RC network reaches a predetermined level based upon component selection, the control circuit 400 shuts down. A pair of current limiting resistors 421, 422 limit the current between the forward F and reverse R outputs on the microprocessor 450, and the inputs L1 and L2 on the H-Bridge motor driver 423. In an embodiment of the present invention, the values of the various components may be as follows: capacitor 409=220 uF; resistor 411=2.2K ohm; diode 413=33V zener diode voltage; capacitor 419=0.1 uF; diodes 433, 434=200V, 1 amp; resistors 429, 431=30 ohm; capacitors 432, 433=4.7 uF; resistors 421, 422=10K ohm; resistor 427=0.25 ohm; resistor 425=1M ohm; and capacitor 426=220 uF. In addition, these values should not be construed as limiting as the components used to form the control circuit 400 may comprise different electrical values and ratings than that of the example previously discussed, without affecting the operation of the control circuit 400.

Figure 5A:
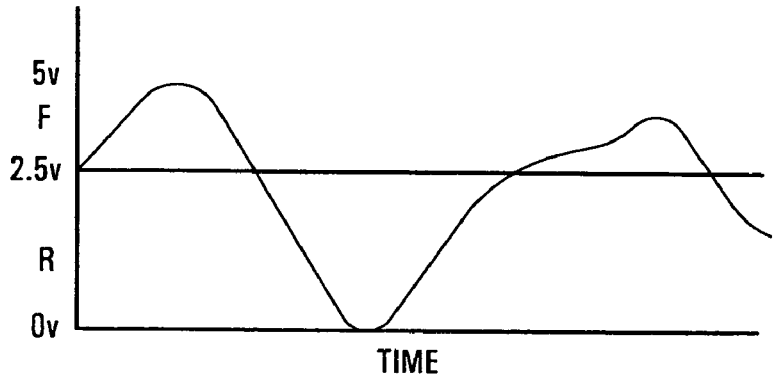
FIG. 5A is a graphical display of the voltage generated by the Hall effect sensor that is input to the microprocessor as a function of time, according to the preferred embodiment of the present invention.

FIG. 5A, shows the varying Hall voltage that is input to the microprocessor 450, as the handgrip 114 is moved from the neutral position to the maximum forward speed position F, and to the maximum reverse speed position R. Specifically, when the handgrip 114 is in the neutral position, the Hall effect sensor 310 outputs a Hall voltage of approximately 2.5 volts. As the handgrip 114 is moved from the neutral position to the maximum forward position in the direction F, the Hall voltage increases in a substantially linear manner from 2.5 volts to a maximum of approximately 5 volts, thus indicating the maximum forward speed of the vacuum cleaner 10. Alternatively, as the handgrip 114 is moved from the neutral position of 2.5 volts to the maximum reverse position in the direction R, the Hall voltage decreases in a substantially linear fashion from 2.5 volts to 0 volts, thus indicating the maximum reverse speed of the vacuum cleaner 10. The microprocessor 450, in response to the receipt of the various Hall voltages described, generates a PWM control signal based on the preprogrammed response characteristics shown in FIGS. 5B-5D to control the movement of the vacuum cleaner 10.

Figure 5B:
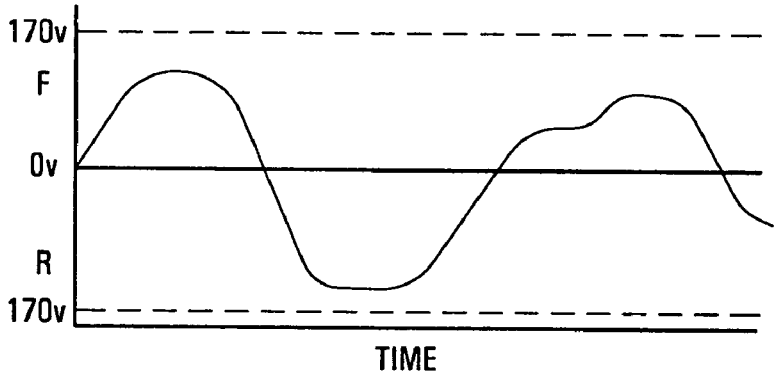
FIG. 5B is a graphical display of the voltage applied to the propulsion motor as a function of time based upon the input to the microprocessor from the Hall effect sensor as shown in FIG. 5A, according to the preferred embodiment of the present invention.
Figure 5C:
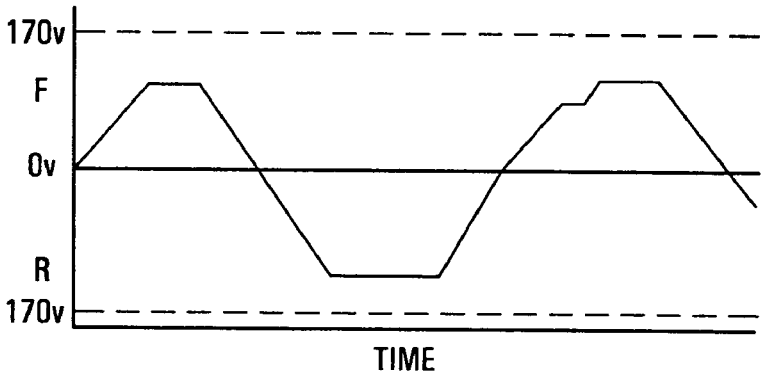
FIG. 5C is a graphical display of the voltage applied to the propulsion motor as a function of time based upon the input to the microprocessor from the Hall effect sensor as shown in FIG. 5A, according to an alternate embodiment of the present invention.
Figure 5D:
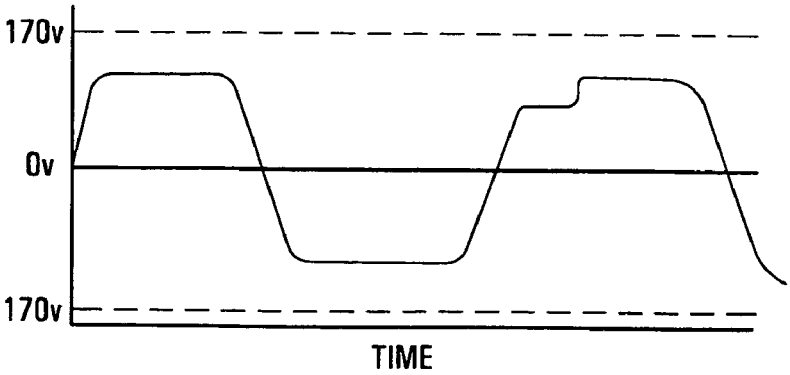
FIG. 5D is a graphical display of the voltage applied to the propulsion motor as a function of time based upon the input to the microprocessor from the Hall effect sensor as shown in FIG. 5A, according to another alternate embodiment of the present invention.

FIGS. 5B-5D depict various response characteristics that may be utilized by the vacuum cleaner 10 in accordance with the concepts of the present invention. Thus, each of the response characteristics 5B-5D determines the particular responsiveness that is delivered by the motor 105 in response to movements of the handgrip 114. Therefore, for a given Hall voltage identified in FIG. 5A, the microprocessor 450 generates an associated PWM control signal in accordance with one of the response characteristics 5B-5D that is being used. In accordance with the response characteristic shown in FIG. 5B, as the handgrip 114 is moved linearly in the forward direction F, the Hall voltage begins to increase to a maximum of 5V, while the voltage of the PWM control signal applied to the motor 105 via the microprocessor 450 rises proportionally, and begins to smooth off as the maximum voltage of 170 volts is applied to the motor 105. As the handgrip 114 is pulled back in the reverse direction R, the Hall voltage begins to drop back to a low of 2.5 volts (neutral) as the handgrip 114 returns to the neutral position. As the handgrip 114 is pulled further into the reverse direction R, the Hall voltage drops from 2.5 volts (neutral) to a low of 0 volts when the handgrip 114 is in the maximum reverse speed position. The microprocessor 450 pulse width modulates the voltage carried by the PWM control signal to the motor 105 via the H-bridge motor driver 423, so that the voltage delivered to the motor 105 will first begin to drop in a smooth manner and then proportionally based on the position of the handgrip 114 as it is pulled from the forward speed position towards the neutral position.

Similarly, the microprocessor 450 pulse width modulates the voltage carried by the PWM control signal to motor 105, so that the voltage delivered to the motor 105 increases proportionally during the travel of the handgrip 114 in the reverse direction R, and begins to smooth off as the maximum of 170 volts is reached. If the handgrip 114 is moved from the neutral position in a linear manner, as shown in FIG. 5A, the response of the motor 105 will be linear for the majority of the travel of the handgrip 114, except as the handgrip 114 approaches the maximum forward and reverse operating speeds as seen in FIG. 5B. If the handgrip 114 is not moved from the neutral position in a linear fashion, as demonstrated by the portion of the line graph to the right in FIG. 5A, the response of the motor 105 will not be linear as it approaches operating speed as demonstrated by the portion of the line graph to the right in FIG. 5B.

In an alternate embodiment of the present invention, and referring now to FIG. 5C, the microprocessor 450 can be programmed with a response characteristic to pulse width modulate the voltage carried by the PWM control signal to the motor 105, via the H-bridge 423, so that the voltage increases linearly to operating speed, as the handgrip 114 is moved in the forward F or reverse R directions. Once the handgrip 114 is in the fully forward or reverse positions, the voltage delivered to the motor 105 is then capped at a peak voltage and will stay at that voltage until the handgrip 114 is released, at which time the voltage will drop in a linear fashion until it reaches zero. If the handgrip 114 is not moved in a linear fashion in the forward F and reverse R directions (as demonstrated by the right portion of FIG. 5C) the microprocessor 450 still pulse width modulates the voltage applied to motor 105 via the H-bridge 423 so that the voltage increases linearly to the operating speed and will remain constant until the handgrip 114 is moved again in either direction.

In another embodiment of the present invention, the microprocessor 450 may be programmed with a response characteristic that generates the response shown in FIG. 5D, which will be discussed in detail below. As the handgrip 114 is moved linearly in the forward F or reverse R directions, the microprocessor 450 pulse width modulates the voltage carried by the PWM control signal to the motor 105, so that the voltage increases linearly at a higher rate towards operating speed, but is smoothed slightly just before operating speed is reached. Once operating speed is reached, the voltage remains constant until the handgrip 114 is released, at which time the voltage will begin to drop smoothly at first but then decreases in a linear fashion until it reaches zero. If the handgrip 114 is not moved in a linear fashion in the forward and reverse directions (as demonstrated by the right portion of FIG. 5D) the microprocessor 450 still pulse width modulates the voltage carried by the PWM control signal to the motor 105, so that the voltage increases at the same aforesaid linear rate, but is smoothed just before the operating speed is reached. The voltage will remain constant until the handgrip 114 is moved again in either direction, at which point the voltage will either smoothly increase or decrease before increasing or decreasing at the aforesaid linear rate. Although specific examples of the various response characteristics having different responses or response attributes that may be used to control the operation of the motor 105 have been disclosed, there are many other possible response characteristics that may be programmed into the memory of the microprocessor 450. For example, various response attributes may be comprised of different rates of acceleration and deceleration, such as exponential or linear rates, of the movement of the cleaner 10, in response to the movements of the handgrip 114.

The response characteristics discussed with respect to FIGS. 5B-5D while shown as graphs, are embodied as lookup tables maintained by the memory of the microprocessor 450. The lookup table contains a range of predetermined digital Hall voltage levels that are each associated with a specific PWM output level or magnitude, carried by the PWM control signal control signal to the motor 105. As such, the microprocessor 450 is able to lookup the voltage level to be applied to the motor 105 based on the particular Hall voltage generated by the position of the handgrip 114.

In another embodiment of the present invention, two Hall effect sensors with a single magnet could be utilized as a triggering mechanism having two voltages, which are input to the microprocessor 450 for controlling the motor voltage and direction. Alternately, instead of a moving handgrip, a wheel sensor (not shown) could be utilized to detect the movement of the cleaner suction nozzle when the user pushes or pulls on the cleaner handgrip 114. The wheel sensor could sense the speed and detect both the amount of force transmitted to the suction nozzle via the handle and produce a representative voltage, which is input to the microprocessor 450. The microprocessor 450 may then use pulse width modulation on L1, L2, H1 and H2 to control direction and speed of motor M. Of course microprocessor 450 can be programmed with any desired response characteristic to provide a desired output to the motor 105 based on the position of the handgrip 114.

Figure 6:
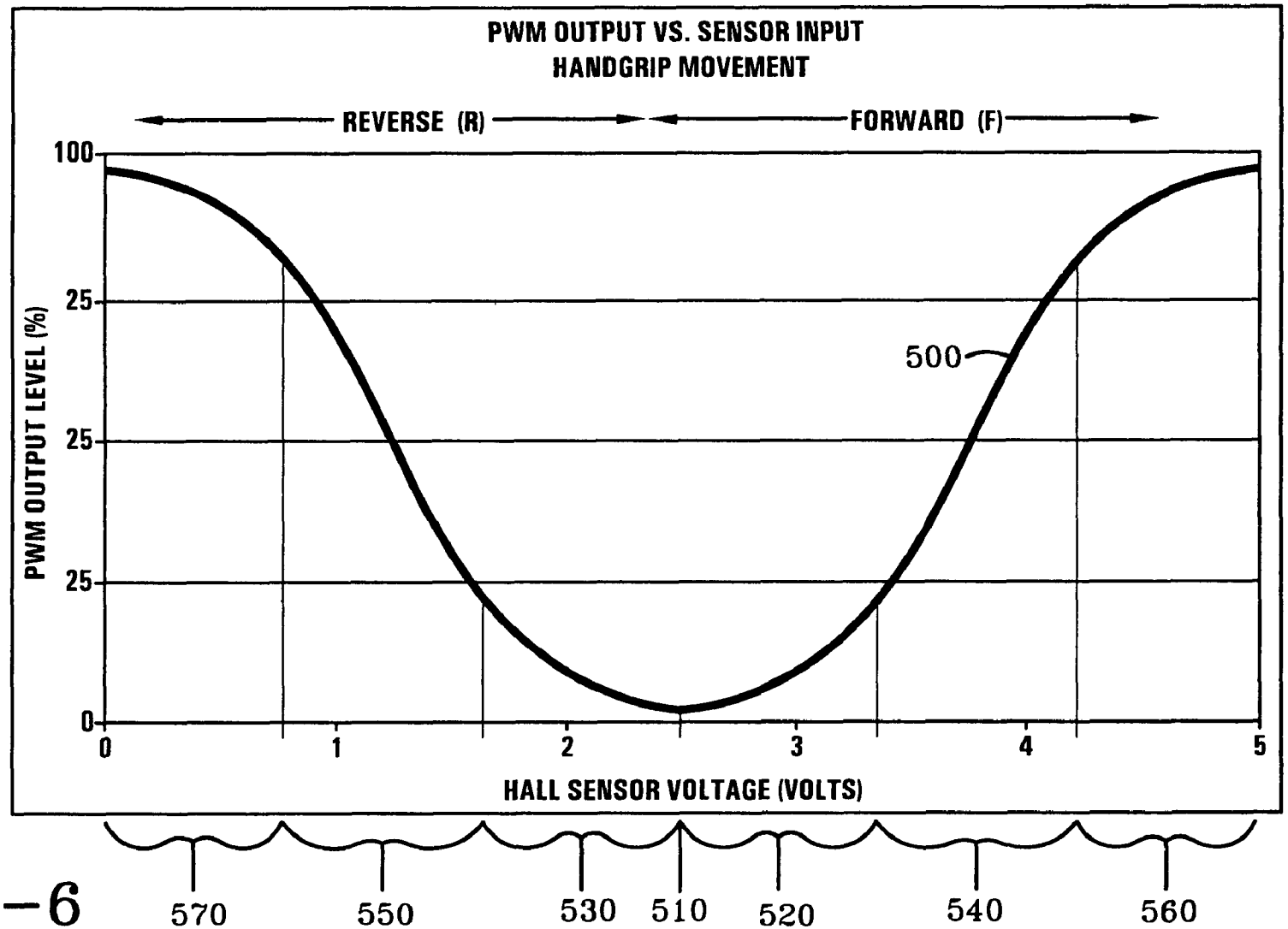
FIG. 6 is a graphical display of a response characteristic comprising a non-linear logistic function used to generate PWM signals based on the voltage output of the Hall sensor according to the position of the handgrip.

In another embodiment of the present invention, a graphical depiction of a response characteristic based upon a nonlinear logistic function is referred to by the numeral 500 as shown in FIG. 6 of the drawings. The logistic function may be defined by the equation:

$$\tanh(t) = \frac{e^{t} - e^{-t}}{e^{t} + e^{-t}},$$

which is also referred to in the art as the hyperbolic tangent function. Specifically, the response characteristic 500 of FIG. 6 shows the change of the PWM (pulse width modulation) output level with respect to change in Hall voltage due to the movement of the handgrip 114. In other words, the logistic response characteristic 500 determines the level (or percentage) of pulse width modulation (PWM) that the PWM control signal will use to drive the motor 105 based on the value of the Hall voltage, so as to control the movement of the vacuum cleaner 10 in forward F' and reverse R' directions. It should be appreciated that an increase in PWM output level corresponds to an increase in motor speed, while a decrease in PWM output level corresponds to a decrease in motor speed.

In general, the logistic function is used to model natural phenomena, such as bacterial growth, human population growth and the like. Thus, due to the ability of the logistic function to model naturally occurring phenomena, its use as a response characteristic, provides the user with a natural and fluid control to the movement of the self-propelled vacuum cleaner 10 as it is moved in forward F' and reverse R' directions by the handgrip 114.

For example, as the handgrip 114 is moved in the forward direction F from the neutral position 510, the Hall voltage initially increases, such that various regions that determine the PWM output level of the microprocessor 450 are encountered. Specifically, when the analog Hall voltage is between 2.5V and 3.25V the forward starting region 520 is encountered, whereby a slow exponential increase in motor speed is provided. When the Hall voltage increases between 3.25V and 4.25V, the forward linear region 540 is encountered, whereby a linear change in motor speed is provided. Finally, when the Hall voltage is between 4.25V and 5V the forward saturation region 560 is encountered, such that the linear response in motor speed is terminated by a gradual exponential decay, as the maximum forward speed of the motor 105 is attained. Correspondingly, as the handgrip 114 is moved in the reverse direction R, the Hall voltage decreases, such that between 2.5V and 1.75V the reverse starting region 530 is encountered, whereby a slow exponential increase in reverse motor speed is provided. As the Hall voltage decreases between 1.75V and 0.75V the reverse linear region 550 is encountered, whereby a linear change in motor speed is provided. Finally, when the Hall voltage decreases to between 0.75V and 0V the reverse saturation region 570 is encountered such that the linear response in motor speed is terminated by a gradual exponential decay, as the maximum reverse speed of the motor 105 is attained.

Prior to discussing the effects that the response characteristic 500 has on the responsiveness of the movement of the vacuum 10 in response to a user's control, a brief discussion of the operation of the vacuum cleaner 10 will be provided. During operation of the vacuum cleaner 10, the magnitude of the digitized Hall voltage generated in a manner previously discussed varies linearly, at a given rate, based upon the position of the handgrip 114. Next, as the Hall voltage changes due to the movement of the handgrip 114, the regions 520-570 of the logistic response characteristic 500 are processed by the microprocessor 450. Thus, the microprocessor 450 accesses the lookup table and identifies the PWM output level associated with the specific Hall voltage currently being generated by the handgrip 114. Once the PWM output level is identified, the microprocessor 450 sends a forward or reverse PWM control signal having the identified PWM output level to the motor 105 to propel the vacuum cleaner 10.

The process of generating a PWM output level for a specific Hall voltage is completed by a lookup table maintained by the microprocessor 450. Specifically, the lookup table maintains a plurality of digital Hall voltage levels, each of which are related to a specific PWM output level that is established in accordance with the logistic response characteristic 500. By maintaining the Hall voltage levels in a lookup table, the microprocessor 450 can scale the number of Hall voltage levels used, so that different levels of responsiveness with different maximum PWM output levels can be created, while still retaining the specific mathematical characteristics defined by the logistic function 500. In one aspect, a response button 590 coupled to the microprocessor 450 as shown in FIG. 5 may be used to initiate the re-scale of the number of Hall voltage levels used by the lookup table. In other words, the number of digital voltage levels used by the lookup table may be increased or decreased as desired by the actuation of the response button 590.

Figure 7:
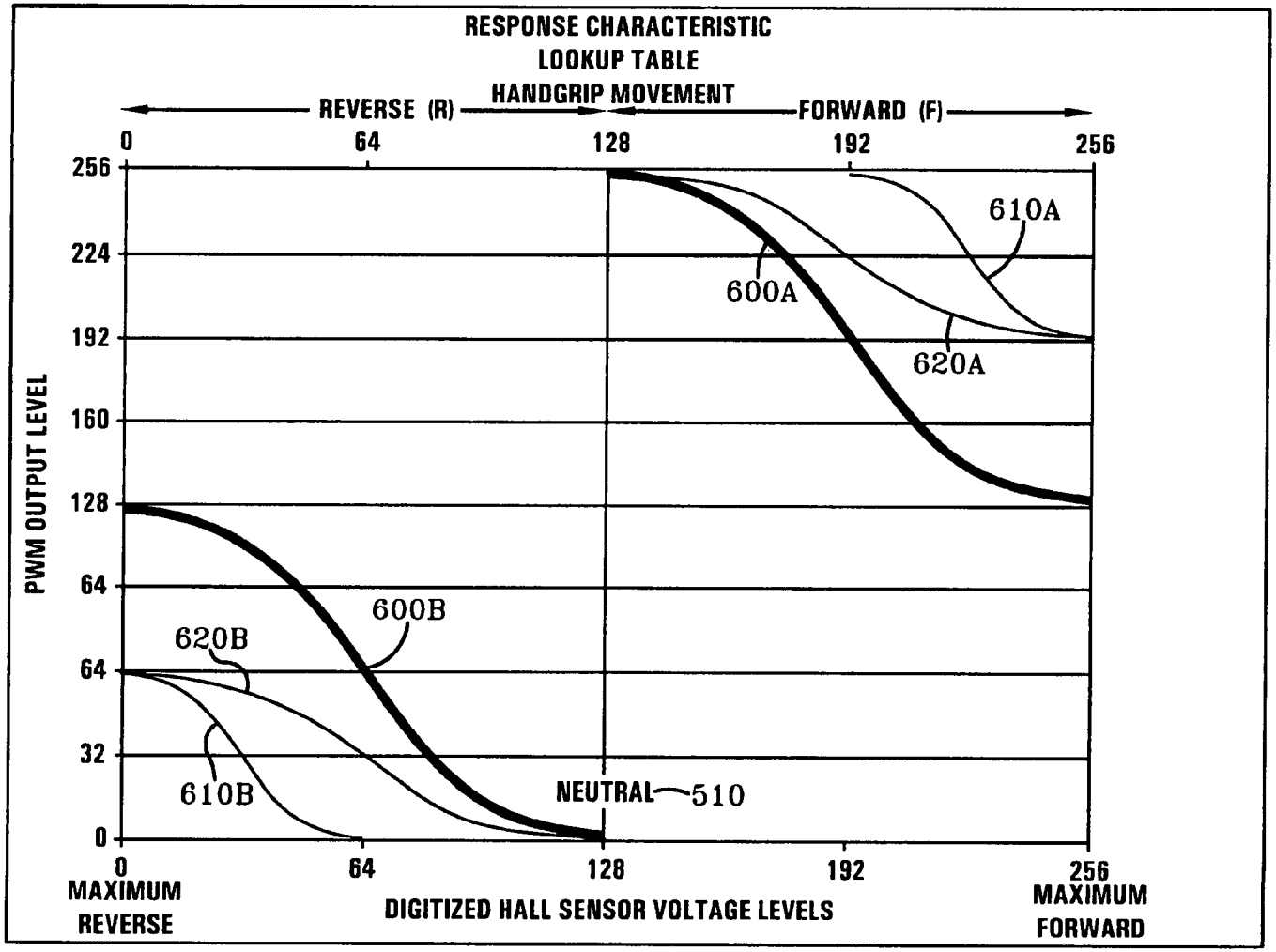
FIG. 7 is a graphical display of a lookup table maintained by the microprocessor which represents a plurality of digital Hall voltage levels that are associated with corresponding discrete PWM output levels in accordance with the logistic function based response characteristic.

FIG. 7 graphically shows an exemplary lookup table using the response characteristic 500 for forward and reverse movements of the vacuum cleaner 10. Moreover, FIG. 7 shows the logistic function based relationship between a plurality of digitized Hall voltage levels (0 to 256) and each digital PWM output level (0 to 256) that is associated therewith. For the purposes of clarity, due to the inherent operation of the H-bridge motor driver 423, the reverse response characteristics 600B, 610B, and 620B are discontinuous with the forward response characteristics 600A, 610A, and 620A maintained by the lookup table. However, it should be apparent from FIG. 7 that when moving the handgrip 114 in the reverse direction R, the vacuum cleaner begins to move in the reverse direction R', and when the handgrip 114 is moved in the forward direction F, the vacuum cleaner 10 begins to move in the forward direction F'. Continuing, un-scaled forward and reverse response characteristics 600A and 600B based on the logistic response characteristic 500 shown in FIG. 6, illustrates the response that is generated when the lookup table utilizes 128 Hall voltage levels to represent both the forward F and reverse R movements of the handgrip 114. In contrast, response characteristics 610A and 610B show the response that is generated when the lookup table is re-scaled, and only 64 Hall voltage levels are used to represent the forward F and reverse R movements of the handgrip 114. By scaling the lookup table in such a manner, the maximum PWM output level is decreased by half, while the responsiveness has increased, as compared to the un-scaled response characteristics 600A and 600B that each use 128 discrete Hall voltage levels as previously discussed. As such, the vacuum cleaner 10, is only able to be propelled in the forward F' and reverse R' directions at half the speed that would be possible using the un-scaled response characteristics 600A, 600B. Moreover, the resealing process performed by the microprocessor 450, is completed such that the mathematical relationship established by logistic function 500 is retained by the response characteristics 610A and 610B. In other words, the scaled response characteristics 610A and 610B retain the exponential increase in the starting regions 520,530, the linear ramp in the linear regions 540,550, and the exponential decay in the saturation regions 560,570 of the original response characteristic 500 shown in FIG. 6.

In addition to resealing the hyperbolic tangent function, it may also be modified by multiplying the hyperbolic tangent function, tanh(t), by a coefficient Z, such that:

$$Z \cdot \tanh(t) = Z \cdot \frac{e^{t} - e^{-t}}{e^{t} + e^{-t}}.$$

The use of the coefficient Z allows the logistic function 500 to be altered to provide modified PWM output level responses, as needed to allow the vacuum cleaner 10 to be controlled more efficiently when operated under specific operating conditions. For example, if the vacuum cleaner 10 is being used to vacuum small areas or various types of carpet, the logistic function 500 could be altered to achieve a customized response characteristic that is suited for use in tight or cramped areas. Moreover, the modification of the logistic function by a suitable coefficient Z, allows the user to tailor the responsiveness of the vacuum cleaner's movement to the actuation of the handgrip 114 according to the user's vacuuming technique and physical size and ability. For example, as shown in FIG. 7, by providing a suitable coefficient Z, forward and reverse response characteristics 620A and 620B may be created to provide a responsiveness that is approximately 50% slower than that of the un-scaled forward and reverse response characteristics 600A and 600B. Thus, it is contemplated that the response button 590 may provide various positional settings that allows a user of the vacuum cleaner 10 to select the particular coefficient Z used to alter the PWM output levels generated by the logistic function 500.

The following discussion will set forth the particular operation of the vacuum cleaner 10 using the logistic response characteristic 500, as the user actuates the handgrip 114 to move the vacuum cleaner 10 in forward F' and reverse R' directions. Although the following discussion relates to the use of the logistic response characteristic 500 as shown in FIG. 6, it should be appreciated that the microprocessor 450 controls the motor 105 in accordance with the response characteristic 500 by utilizing the lookup table values comprising the digitized PWM output levels and digitized Hall voltage levels that embody the response characteristic 500 as previously discussed.

Initially, before the vacuum cleaner 10 is put into operation, the handgrip 114 rests in a neutral position 510. Additionally, the following discussion makes reference to PWM output levels in terms of percentage values. As such, an increase in the PWM output level percentage corresponds to an increase in motor speed, while a decrease in the PWM output level percentage corresponds to a decrease in motor speed. In neutral, the Hall sensor 310 outputs a voltage of approximately 2.5V, which corresponds to a PWM output signal having a PWM output level of approximately 0%. As the user urges the handgrip 114 in the forward direction F, within the forward starting region 520, the PWM output level slowly increases in an exponential manner, until it reaches a PWM level of approximately 25%, causing the vacuum cleaner 10 to slowly move forward. As the handgrip 114 continues to be moved forward, the forward linear region 540 is reached, where user adjustments to the movement of the handgrip 114 results in a linear response or change in motor speed and corresponding vacuum cleaner movement. If the user continues to move the handgrip 114 forward, he or she eventually reaches the end of the linear region, which corresponds to a PWM level of approximately 75%. With continued forward movement of the handgrip 114, the forward saturation region 560 is reached, whereby the linear rate of increase provided by the forward linear region 540 begins to slowly decay in an exponential manner, until a maximum PWM level of 100% is delivered to the motor 105, causing the vacuum cleaner 10 to move full speed in the forward direction F'.

Alternatively, when the handgrip 114 is moved from the neutral position 500, in the reverse direction R, the reverse starting region 530 is encountered whereby, the PWM output level slowly increases in an exponential manner, until it reaches a PWM level of approximately 25%. As the handgrip 114 is continued to be moved in the reverse direction R, the reverse linear region 550 is reached, where adjustments to the movement of the handgrip 114 result in a linear response or change in motor speed and movement of the vacuum cleaner 10. If the user continues to move the handgrip 114 in the reverse direction R, he or she eventually reaches the end of the reverse linear region 550, which corresponds to a PWM output level of approximately 75%. With continued movement of the handgrip 114 in the reverse direction R, the reverse saturation region 570 is reached, whereby the linear rate of increase provided by the reverse linear region 550 begins to slowly decay in an exponential manner, until a maximum PWM level of 100% is delivered to the motor 105, causing the vacuum cleaner 10 to move full speed in the reverse direction R'.

It will, therefore, be appreciated that one advantage of one or more embodiments of the present invention is that a self-propelled vacuum cleaner may be controlled via movements of a handgrip. Yet another advantage of the present invention is that the self-propelled vacuum cleaner utilizes a logistic function based response characteristic to provide a natural and fluid movement of the vacuum cleaner in response to the movements of the handgrip. Still another advantage of the present invention is that a lookup table stored by the microprocessor, and maintained by the self-propelled vacuum cleaner, may be scaled as desired so as to create a variety of response characteristics.

What is claimed is:

1. A self-propelled floor care appliance controlled by a moveable handgrip comprising:

a drive motor to control the movement of the floor care appliance;

a Hall effect sensor in operative communication with the handgrip, said Hall effect sensor configured to generate a Hall voltage based on the movement of the handgrip in at least a limited reciprocal rectilinear motion;

a microprocessor coupled to said Hall effect sensor, and to store a response characteristic, wherein said response characteristic comprises a logistic function;

a selection switch coupled to said microprocessor to select one of at least two response characteristics for at least direction and speed of the appliance maintained by said microprocessor;

a lookup table maintained by said microprocessor, said lookup table associating a plurality of predetermined digital Hall voltage levels with predetermined pulse width modulation (PWM) output levels in accordance with a logistic response characteristic including at least both direction of movement of the appliance and speed of the appliance;

wherein said microprocessor outputs a pulse width modulation (PWM) control signal to said drive motor, such that said PWM control signal includes one of said PWM output levels associated with said Hall voltage output by said Halt effect sensor in accordance with said lookup table;

wherein said logistic function comprises a hyperbolic tangent function having the formula:

$$\mathrm{Tanh}(t) = \frac{e^{t} - e^{-t}}{e^{t} + e^{-t}}.$$

2. The self-propelled floor care appliance of claim 1, wherein said logistic function is non-linear.

3. The self-propelled floor care appliance of claim 1, wherein said hyperbolic tangent function is scaled by a coefficient.

4. The self-propelled floor care appliance of claim 1, wherein said hyperbolic tangent function is multiplied by a coefficient, so as to alter the response of said logistic response characteristic.

5. The self-propelled floor care appliance of claim 1, further comprising an H-bridge motor diver coupled between said microprocessor and said motor drive, said H-bridge configured to control said motor drive in accordance with said PWM control signal.

6. The self-propelled floor care appliance of claim 1, further comprising:

a response button coupled to said microprocessor, wherein actuation of said response button adjusts the total number of said predetermined digital Hall voltage levels maintained by said lookup table.

7. The self propelled floor care appliance of claim 6, wherein the magnitude of said predetermined PWM output levels are adjusted based on the total number of predetermined digital voltage levels used.

8. A method for controlling the movement of a microprocessor controlled, motor driven vacuum cleaner in accordance with a movable handgrip, comprising: generating a digitized Hall voltage based upon the position of the handgrip in at least a limited reciprocal rectilinear range of motion; providing the microprocessor with a response characteristic comprising a logistic function represented by a lookup table stored by said processor that associates a plurality of predetermined Hall voltage levels with associated predetermined PWM output levels; generating a pulse width modulation (PWM) control signal containing a pulse width modulation output level based on the position of the handgrip and said response characteristic; and controlling the motor in accordance with said PWM control signal, so as to propel the floor care appliance in accordance with the movement of the handgrip in one of a) speed and b) direction and speed; wherein said logistic function comprises a hyperbolic tangent function having the formula:

$$\mathrm{Tanh}(t) = \frac{e^{t} - e^{-t}}{e^{t} + e^{-t}}.$$

9. The method of claim 8, wherein said first generating step is performed by an analog-to-digital converter (ADC).

10. The method of claim 8, further comprising: adjusting the total number of said predetermined Hall voltage levels, so as to alter the values of said predetermined PWM output levels, thus changing the response of said response characteristic.

* * * * *